US011149506B2

(12) United States Patent
Spencer et al.

(10) Patent No.: US 11,149,506 B2
(45) Date of Patent: Oct. 19, 2021

(54) SYSTEM FOR CONTROLLING WELLBORE PRESSURE DURING PUMP SHUTDOWNS

(71) Applicant: Expro Americas LLC, Houston, TX (US)

(72) Inventors: Danny Spencer, Houston, TX (US); John McCaskill, Jersey Village, TX (US); John McHardy, Houston, TX (US); Scott Charles, Houston, TX (US)

(73) Assignee: Expro Americas, LLC, Houston, TX (US)

( * ) Notice: Subject to any disclaimer, the term of this patent is extended or adjusted under 35 U.S.C. 154(b) by 317 days.

(21) Appl. No.: 15/311,700

(22) PCT Filed: May 19, 2015

(86) PCT No.: PCT/US2015/031590
§ 371 (c)(1),
(2) Date: Nov. 16, 2016

(87) PCT Pub. No.: WO2015/179408
PCT Pub. Date: Nov. 26, 2015

(65) Prior Publication Data

US 2017/0089156 A1 Mar. 30, 2017

Related U.S. Application Data

(60) Provisional application No. 62/000,283, filed on May 19, 2014.

(51) Int. Cl.

| | |
|---|---|
| ***E21B 21/08*** | (2006.01) |
| ***E21B 47/06*** | (2012.01) |
| ***E21B 21/10*** | (2006.01) |

(52) U.S. Cl.
CPC ..... *E21B 21/08* (2013.01); *E21B 21/106* (2013.01); *E21B 47/06* (2013.01)

(58) Field of Classification Search
CPC ..... E21B 21/08; E21B 47/06; E21B 21/106
See application file for complete search history.

(56) References Cited

U.S. PATENT DOCUMENTS

| | | | |
|---|---|---|---|
| 3,362,487 | A | 1/1968 | Lindsey et al. |
| 3,443,643 | A | 5/1969 | Jones et al. |
| 3,477,526 | A | 11/1969 | Jones et al. |
| 3,677,353 | A | 7/1972 | Baker et al. |
| 3,827,511 | A | 8/1974 | Jones |
| 4,253,530 | A | 3/1981 | Sharki et al. |

(Continued)

OTHER PUBLICATIONS

EP search report for EP15796194.7 dated Jan. 10, 2018.

*Primary Examiner* — Catherine Loikith
(74) *Attorney, Agent, or Firm* — Getz Balich LLC

(57) ABSTRACT

A system and method for maintaining fluid pressure within a well bore includes: (a) an axially reciprocable choke; (b) a mud pump; (c) a programmable controller in communication with the choke and providing operational control of the axial reciprocation of the choke to maintain a set point choke pressure; (d) the controller configured to associate a drilling set point choke pressure within the well bore with a drilling pump rate and associate a predetermined connection set point choke pressure within the well bore with a pump rate; and (e) a mud pump monitor configured to communicate with the mud pump and the programmable controller, measure the pump rate of the pump, and communicate the measured pump rate to the programmable controller.

15 Claims, 4 Drawing Sheets

(56) References Cited

U.S. PATENT DOCUMENTS

| | | | |
|---|---|---|---|
| 4,595,343 | A | 6/1986 | Thompson et al. |
| 5,245,104 | A | 9/1993 | Cullick |
| 5,273,112 | A | 12/1993 | Schultz |
| 5,868,201 | A | 2/1999 | Bussear et al. |
| 5,934,371 | A | 8/1999 | Bussear et al. |
| 6,192,980 | B1 | 2/2001 | Tubel et al. |
| 6,257,332 | B1 | 7/2001 | Vidrine et al. |
| 6,293,341 | B1 | 9/2001 | Lemetayer |
| 6,352,129 | B1 | 3/2002 | Best |
| 6,374,925 | B1 | 4/2002 | Elkins et al. |
| 6,527,062 | B2 | 3/2003 | Elkins et al. |
| 6,575,244 | B2 | 6/2003 | Chang et al. |
| 6,923,273 | B2 | 8/2005 | Terry et al. |
| 6,944,547 | B2 | 9/2005 | Womer et al. |
| 2001/0013412 | A1 | 8/2001 | Tubel |
| 2003/0079912 | A1 | 5/2003 | Leuchtenberg |
| 2004/0144565 | A1 | 7/2004 | Koederitz |
| 2004/0217879 | A1 | 11/2004 | Guggari et al. |
| 2005/0006150 | A1 | 1/2005 | Sims et al. |
| 2005/0092523 | A1 | 5/2005 | McCaskill et al. |
| 2006/0086538 | A1 | 4/2006 | Van Riet |
| 2011/0067923 | A1 | 3/2011 | Leuchtenberg |
| 2011/0253445 | A1 | 10/2011 | Hannegan et al. |
| 2012/0061087 | A1 | 3/2012 | Iblings et al. |

Choke Control System

Choke Control System

SYSTEM FOR CONTROLLING WELLBORE PRESSURE DURING PUMP SHUTDOWNS

CROSS-REFERENCE TO RELATED APPLICATION(S)

This application claims priority to PCT Patent Appln. No. PCT/US2015/031590 filed May 19, 2015, which claims the benefit of U.S. Provisional Application No. 62/000,283, filed May 19, 2014, the contents of which are incorporated herein by reference.

FIELD

The present disclosure relates to a method and apparatus for maintaining well pressure control despite fluctuations arising due to mud pump shutdowns. More particularly, the present disclosure relates to a method and apparatus for closely coordinating changes in mud pump speed, or the flow rate of drilling mud, with the operation of choke valves for the maintenance of a constant drilling fluid pressure during interruptions to mud pump circulation such as for the addition of drill pipe sections to the drill string.

BACKGROUND

Deepwell boreholes, such as oil and gas wells, are drilled with rotary drilling rigs. As the drill bit advances through the formation, the cuttings are removed from the borehole by a circulating drilling fluid, commonly referred to as drilling mud, which is conveyed down a drillstring and which is then circulated back to the surface in the well bore.

The drilling mud produces a fluid density dependent hydrostatic pressure head within the borehole. Additionally, a mud circulation flow rate dependent hydrodynamic pressure also acts on the downhole formations to counterbalance their formation pressures. One part of this hydrodynamic pressure is provided by flow friction in the well annulus between the drillstring and the well bore. A second part of this hydrodynamic pressure is provided by a Choke valve which can be moved between a fully closed position and continuously variable flow restrictive positions. The more open the choke valve, the less the hydrodynamic restriction imposed on the outflow of the well by the choke. When the well circulation is stopped, a check valve in the drillstring, herein termed a float valve, and the choke valve can close to entrap and retain pressure within the well annulus.

Choke devices are commonly used in the oilfield when drilling wells for oil or natural gas in order to control or prevent undesired escape of formation fluids. Herein, the term "hydraulic choke" is taken to refer to the fact that the device is used with a variety of fluids, such as drilling mud, salt water, oil, and natural gas. "Hydraulic" does not herein refer to the choke actuation means, although the actuators are typically hydraulically powered. The hydraulic choke is utilized as a pressure-reducing valve for fluids outflowing from the well.

The combination of the well circulation system annular hydrostatic and hydrodynamic pressures and, when circulation is stopped, the pressure retained by the choke valve is called the bottom hole pressure (BHP) and is the pressure acting on the formation at the bottom of the well. The bottom hole pressure must be maintained in excess of the formation fluid pressure in order to avoid the uncontrolled outflow of formation fluids from the permeable formations into the wellbore. In the event that such formation fluids do escape into the wellbore, the result is a "well kick". If the escape of fluids were to continue, the result would be a "blow out" wherein formation fluids would totally displace the drilling mud and exit uncontrolled from the well.

On the other hand, if the combined hydrostatic, hydrodynamic, and choke pressure in the wellbore is too high, it will overcome the fracture strength of an uncased rock formation of the well, thereby causing loss of drilling mud to the fractured formation and consequent damage to the physical integrity of the borehole. Additionally, the loss of drilling mud to a fractured formation can then lead to loss of enough hydrostatic mud pressure to enable escape of high pressure formation fluids from other zones. This situation also can lead to a blowout.

The bottom hole pressure (the "BHP") should be maintained between the pore pressure and the fracture pressure for the uncased formations in the well to ensure a safe, well-managed drilling operation. Choke valves are used to control the annulus pressure above, below, or equal to the downhole formation pressure.

Undesirable variations in drilling fluid pressure may occur when changing or stopping the pump circulation rate of the drilling mud into the well unless the choke is appropriately adjusted to compensate. This occurs, for example, whenever additional pipe joints are added or removed from the drill string. At such a time the mud pump is stopped and disconnected from the drill pipe and circulation of the mud is terminated. Although the hydrostatic pressure of the mud column remains in the borehole, the additional hydrodynamic pressure created by the flow from the mud pump is completely lost as the mud pump is shut down. Further, both as the mud pump is slowing down and while it is restarting, the control of the choke in order to compensate for the flow induced variations of hydrodynamic pressure is considerably complicated due to the nonlinearity of hydrodynamic pressure as a function of the circulating rate, particularly for low circulation rates.

A need exists for a more reliable system for controlling choke valves in order to maintain a substantially constant BHP in a suitably responsive, operator friendly manner during ramping down and termination of mud flow.

SUMMARY

The present disclosure relates to a process for maintaining well pressure control despite fluctuations arising due to mud pump speed changes. More particularly, the present disclosure relates to a method and apparatus for closely coordinating changes in mud pump speed, or the flow rate of drilling mud, with the operation of choke valves for the maintenance of a controlled annulus fluid pressure during cessations of well circulation such as during the addition of drill pipe sections to the drill string.

One embodiment of the present disclosure is a system for maintaining a fluid pressure within a well bore comprising: (a) an axially reciprocable choke in fluid communication with an annulus of the well bore; (b) a mud pump for pumping fluid into the well bore, wherein a pump rate of the pump is proportional to the fluid pressure within the well bore; (c) programmable controller in communication with the choke, wherein the programmable controller provides operational control of the axial reciprocation of the choke to maintain a desired set point choke pressure through control of the axial positioning of the choke; (d) a controller readable program code configured to associate a predetermined drilling set point choke pressure within the well bore with a drilling pump rate that is greater than a predetermined connection pump rate, and wherein the program code is configured to associate a predetermined connection set point choke pressure within the well bore with a pump rate that is equal to or less than the predetermined connection pump rate; and (e) a mud pump monitor in communication with the mud pump and the programmable controller, wherein the mud pump monitor measures the pump rate of the pump and communicates the measured pump rate to the programmable controller.

Another embodiment of the present disclosure is a computer-implement method for maintaining fluid pressure within a well bore comprising: (a) associating a predetermined drilling set point choke pressure with a choke pressure for maintaining a fluid pressure within the well bore when a mud pump is pumping at a drilling pump rate; (b) associating a predetermined connection set point choke pressure with the choke pressure for maintaining the fluid pressure within the well bore when the mud pump pumping rate decreases to a connecting pump rate; and (c) programming a choke pressure controller to monitor the mud pump pumping rate and to maintain the choke pressure within the well bore at the drilling set point choke pressure whenever the mud pump is pumping at a greater rate than the connecting pump rate and to maintain the choke pressure within the well bore at the connection set point choke pressure whenever the mud pump is pumping at a rate that is less than or equal to the connecting pump rate.

The foregoing has outlined rather broadly several aspects of the present disclosure in order that the detailed description of the disclosure that follows may be better understood. Additional features and advantages of the disclosure will be described hereinafter which form the subject of the claims. It should be appreciated by those skilled in the art that the conception and the specific embodiments disclosed might be readily utilized as a basis for modifying or redesigning the structures for carrying out aspects of the disclosure. It should be realized by those skilled in the art that such equivalent constructions do not depart from the spirit and scope of the disclosure as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

Figure 1:
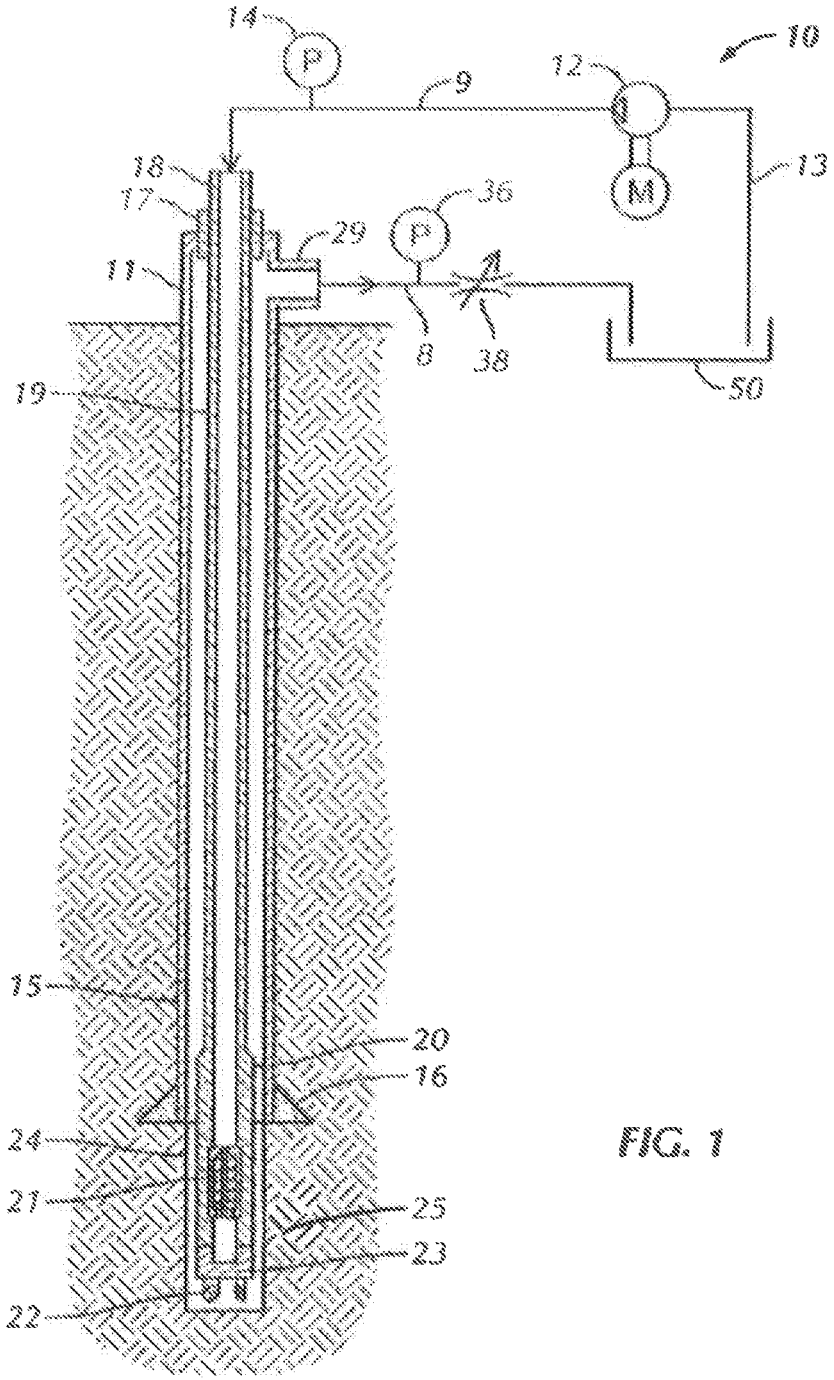
FIG. 1 is a schematic representation of a well pressure control system, showing the arrangement of the well, the drill string, and a simplified arrangement of the fluid circulating system.

The present disclosure relates to a method and apparatus for the operation of hydraulic choke valves for the maintenance of a constant drilling fluid pressure on the downhole formation face despite fluctuations arising due to mud pump speed changes or pump starting and stopping.

The drilling mud produces a fluid density dependent hydrostatic pressure head within the borehole. Additionally, a mud circulation flow rate dependent hydrodynamic pressure also acts on the downhole formations to counterbalance their formation pressures. One part of this hydrodynamic pressure is provided by flow friction in the well annulus between the drillstring and the well bore. A second part of this hydrodynamic pressure is provided by a choke valve which can be moved between a fully closed position and continuously variable flow restrictive positions. The more open the choke valve, the less the hydrodynamic restriction imposed on the outflow of the well by the choke. When the well circulation is stopped, a check valve in the drillstring, herein termed a float valve, and the choke valve work together to entrap and retain pressure within the well annulus.

The combination of the well circulation system annular hydrostatic and hydrodynamic pressures and, when circulation is stopped, the pressure retained by the choke valve is called the bottom hole pressure (the "BHP") and is the pressure acting on the formation at the bottom of the well and is equal to the sum of the hydrostatic mud weight from the column of drilling mud in the annulus (the "MW"), the equivalent circulating density (the "ECD") that refers to the friction losses between the mud flowing up the annulus and the hole internal diameter or casing internal diameter, and the surface back pressure or choke pressure (the "CP"). Thus, BHP=MW+ECD+CP. The bottom hole pressure (the "BHP") can be maintained between the pore pressure and the fracture pressure for the uncased formations in the well to ensure a safe, well-managed drilling operation.

The bottom hole pressure must be maintained in excess of the formation fluid pressure in order to avoid the uncontrolled outflow of formation fluids from the permeable formations into the wellbore. In the event that such formation fluids do escape into the wellbore, the result is an influx that may lead to a "well kick" or uncontrolled influx. If the escape of fluids were to continue, the result would be a "blow out" wherein formation fluids would totally displace the drilling mud and exit uncontrolled from the well.

On the other hand, if the combined hydrostatic, hydrodynamic, and choke pressure in the wellbore is too high, it will overcome the fracture strength of an uncased rock formation of the well, thereby causing loss of drilling mud to the fractured formation and consequent damage the physical integrity of the borehole. Additionally, the loss of drilling mud to a fractured formation can then lead to loss of enough hydrostatic mud pressure to enable escape of high pressure formation fluids from other zones. This situation also can lead to a blowout.

Undesirable variations in drilling fluid pressure may occur when changing or stopping the pump circulation rate of the drilling mud into the well unless the choke is appropriately adjusted to compensate. This occurs, for example, whenever additional pipe joints are added or removed from the drill string. At such a time the mud pump is stopped and disconnected from the drill pipe and circulation of the mud is terminated.

Although the hydrostatic pressure of the mud column remains in the borehole, the additional hydrodynamic pressure created by the flow from the mud pump is completely lost as the mud pump is shut down. Further, both as the mud pump is slowing down and while it is restarting, the control of the choke in order to compensate for the flow induced variations of hydrodynamic pressure is considerably complicated due to the nonlinearity of hydrodynamic pressure as a function of the circulating rate, particularly for low circulation rates.

Historically, variations in the rate of the mud pump and compensating adjustments to the choke have been accomplished by the direct action of human operators pursuant to the shut down plan set out by the drilling engineer. This approach involves adjusting the choke pressure upwards in a step-wise fashion as the pump speed is ramped down or decreased. However, it is a slow process, taking in some cases up to 15-20 minutes and it is difficult to ensure the smooth coordination of the human operators with the desired accuracy. When there is only a small margin between the bottom hole pressure required to prevent formation fluid influx and the fracture pressure of the well bore, choke control becomes especially critical.

Another technique of maintaining the downhole pressure within a desirable range uses an auxiliary pump to inject fluid down the annulus with the choke closed after the pumps are turned off or are slowed. This approach takes time to balance the pressure and complicates the rig flow circuitry, as well as the well cost and maintenance, while not necessarily proving easy to control within the desired accuracy.

Yet another technique of maintaining the downhole pressure has been to use an auxiliary circulation system to keep the mud constantly flowing at all times. These systems are extremely expensive, complex, failure prone and take up extensive rig space.

Modern rigs utilize computers and/or programmable linear controllers using predetermined algorithms and instruments to control the choke for managed pressure drilling ("MPD"). A continuing problem in controlling the BHP is that most pressure control systems respond to pressure reductions in the outflow pressure of a well. Unfortunately when the pump rate into the well changes quickly and significantly, there is a relatively lengthy time lag before the resultant reduced pressure is measured in the outflow pressure. Damage to the well can occur if the downhole pressure is allowed to vary too much before it is corrected. Thus, correcting reductions in the outflow pressure does not provide optimal timely control of the downhole pressure.

The present disclosure contemplates a fast, efficient process for maintaining a desired BHP with an automatic choke back pressure ("ABP") system when the mud pump is slowed or stopped. The process coordinates an interactive mud pump and choke control system to automatically control the annulus pressure during pump shut-down, deceleration or acceleration.

Figure 4:
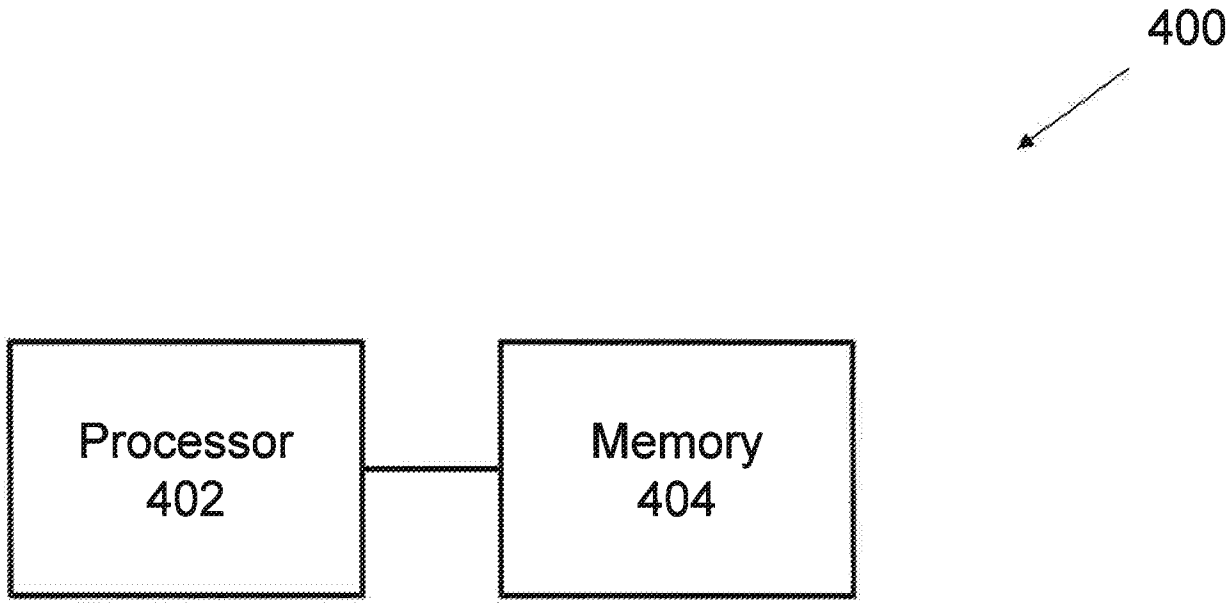
FIG. 4 is a schematic showing the basic blocks of a controller in accordance with one or more aspects of this disclosure.

A programmable logic controller ("PLC") is defined herein as equipment that can run a program, accept data input, calculate and deliver a signal to achieve a desired output. Executable program algorithms, such as found in software, firmware, or state logic, control the operation of the programmable controller. Referring to FIG. 4, in some embodiments a PLC 400 may include one or more processors 402 and memory 404 having instructions stored thereon that, when executed by the one or more processors 402, cause the PLC to perform one or more of the methodological acts described herein.

Referring to FIG. 1, the drilling fluid circulation system 10 for a petroleum well, exclusive of the derrick and other items not pertinent to the drilling circulation system, is shown. The well 11 as shown is not completed for production, but is in a representative drilling arrangement for penetrating a potentially productive geological formation. The well 11 is a cylindrical borehole, not necessarily vertical or straight, which penetrates single or multiple formations 25 and is lined at its upper end by well casing 15. The casing 15 is normally cemented into the ground in order to isolate formations on the exterior of the casing from the wellbore 11, with the lower end of the casing and its annular cement layer indicated by the symbolic casing shoe 16. As shown in FIG. 1, the drill bit 22 has penetrated the geologic formation below the casing shoe 16 and is assumed to be in a potential pay formation which is sensitive to damage from exposure to wellbore pressures higher than its pore pressures.

The drillstring 18 includes, from the upper end, the drill pipe 19, the drill collars 20, a float valve 21 (located between the drill collars 20 and the bit 22), and the drill bit 22. The drill bit 22 when cutting normally is in rotational contact with the bottom of the well, with drill cuttings being circulated away from the bit and up hole in the annulus 24 between the drillstring 18 and the hole via drilling fluids flowing through nozzles 23 in the bit. Drilling fluid is taken from the mud pit 50 through suction line 13 to supply mud pump 12, which in turn pumps drilling fluid through the flow line 9 and down the bore of the drillstring 18. Flow line 9 generally includes a standpipe/drill pipe in the derrick, high pressure hoses, and either a top drive or a kelly. The outlet pressure of the mudpump, termed the standpipe/drill pipe pressure, is measured by standpipe/drill pipe pressure gauge 14 positioned intermediately in flow line 9. Rotating control device (RCD) 17 provides a rotary seal between the top of the casing 15 and the drillstring 18.

The formation 25 is typically competent but porous rock, but it may also be an unconsolidated bed of granular material. Because the formation 25 is relatively permeable and has pressurized somewhat compressible fluids in its communicating pore spaces, flow can occur either into or out of the formation.

Flow from the annulus 24 passes upwardly through the casing 15, closed above by the RCD 17, and exits the casing through a port 29 provided for that purpose such as an RCD outlet, a flow cross or the like. The exiting flow is conducted through a flow line 8 to a choke valve 38. The choke valve 38 has an associated actuator in communication with a choke control system.

The choke valve 38 is basically a selectively variable pressure reducing valve configured for drilling service. Immediately upstream of the choke valve 38 is located a choke pressure gauge 36 for measuring the pressure on the choke inlet. The choke control system or automatic back pressure ("ABP") system is an intelligent PLC based system that automatically maintains a pre-set back pressure on the choke.

A significant problem in controlling the BHP is that most pressure control systems respond to pressure reductions in the outflow pressure of a well. Unfortunately when the pump rate into the well changes quickly and significantly, there is a relatively lengthy time lag before the resultant reduced pressure is measured in the outflow pressure. Damage to the well can occur if the downhole pressure is allowed to vary too much before it is corrected. Thus, correcting reductions in the outflow pressure does not provide optimal timely control of the downhole pressure.

One embodiment of the choke control system of the present disclosure provides an automatic control means for the choke 38 while ramping up or ramping down the mud pump 12 of a mud circulation system 10. The choke control system is particularly intended for use when stopping and restarting mud circulation when making pipe connections when sensitive formations are exposed in the open hole. This control means relies upon an automatic adjustment of one or more chokes 38 in response to changes in the speed of a mud pump 12 and its consequent flow rate and hydrodynamic pressure head in the well annulus 24.

Figure 2:
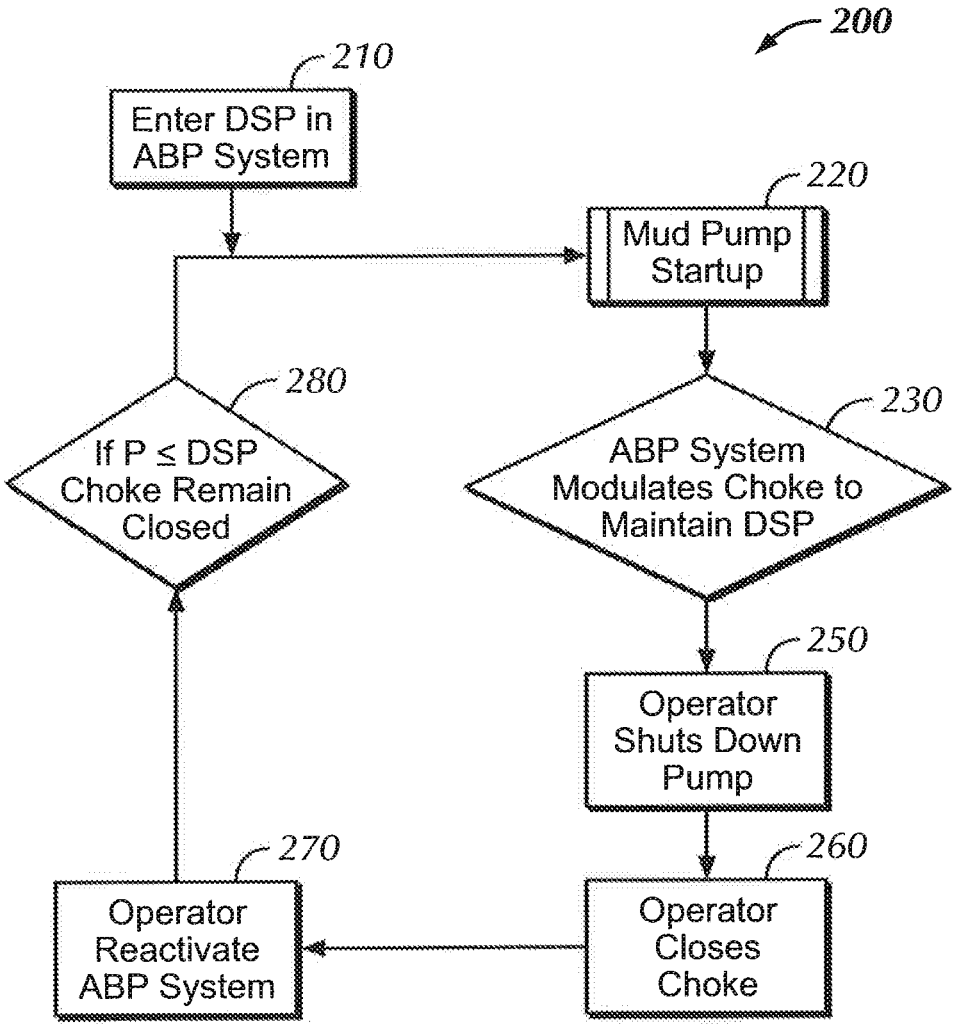
FIG. 2 (Prior Art)
FIG. 2 is a schematic showing the basic blocks in a prior art choke control system algorithm.

One currently used embodiment of a drilling mode choke control system 200 using the ABP system is shown in FIG. 2. The well is configured in the drilling mode (as illustrated in FIG. 1) with the mud pump 12 set to pump at a drilling speed. A desired drilling set point choke pressure ("DSP") is calculated using the MW and the ECD of the well during drilling. The DSP (block 210) is entered into the ABP system before the drilling starts. Once the pump starts pumping (block 220), the BHP rises and the MW system modulates the choke 38 (block 230) in order to maintain the desired CP needed to maintain the desired BHP while drilling. A well-managed drilling operation will maintain a BHP between the pore pressure and the fracture pressure for the uncased formations in the well.

When the pump is to be stopped in order to make a connection ECD is lost and a higher CP is held to compensate, the pump operator takes the system out of the automatic ABP mode and manually ramps down the pump (block 250). As the mud pump 12 reduces its speed or strokes per minute ("SPM"), the mud pump operator quickly closes the choke (block 260) in hopes of trapping sufficient pressure in the system to maintain the BHP.

Once the choke has been closed, the operator reactivates the ABP system (block 270). If the trapped choke pressure is less than or equal to the DSP, the choke 38 will remain closed (block 280). Thus, if the retained choke pressure is less than the DSP as to cause the BHP to fall below the uncased formation pore pressure, the well will experience some influx from its formations until the wellbore pressure is equal to that of the highest pressure porous formation exposed in the wellbore. On the other hand, if the trapped system pressure spikes more than, e.g., 10 or 20 psi above the drilling set point the choke will open and will often bump, in an effort to maintain the DSP.

Once the connection has been made and the mud pump is restarted (block 220), the choke 38 will be modulated as before by the ABP system to maintain the DSP (block 230), thereby keeping the BHP between the pore pressure and the fracture pressure for the uncased formations in the well.

Figure 3:
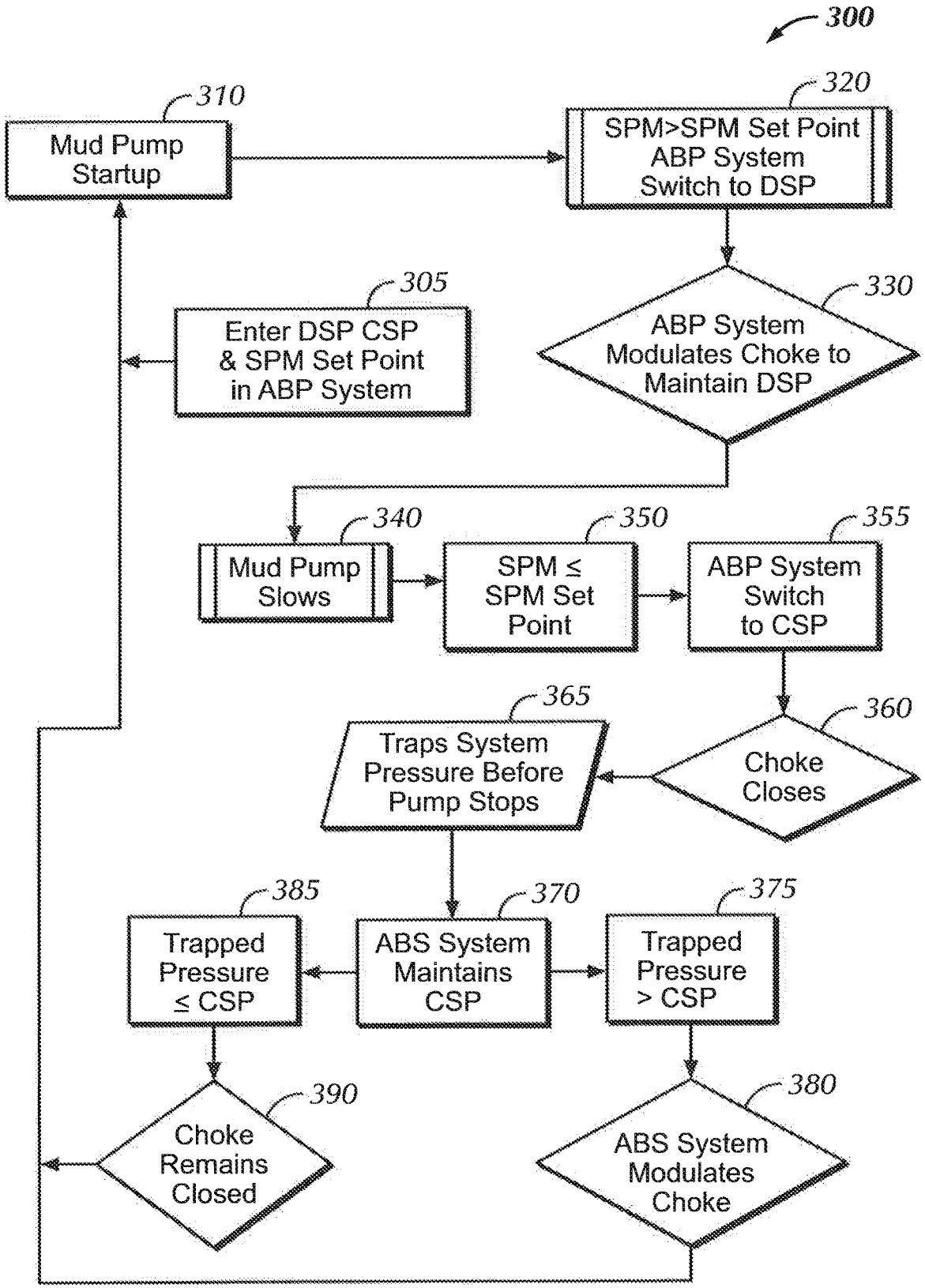
FIG. 3 is a schematic showing the basic blocks of one embodiment of the choke control system algorithm of the present disclosure.

FIG. 3 illustrates one embodiment of the choke control system 300 of the present disclosure used when the well is in the drilling mode (as illustrated in FIG. 1). The ABP system is programmed to monitor the pump speed at all times during the operation of the well.

A predetermined SPM set point is defined that indicates that the pump is shutting down or starting up. The predetermined SPM set point is typically selected to be in the range of, e.g., 5-25% of the drilling speed of the pump. For example, when the drilling speed of the pump is 100 SPM, the predetermined SPM set point would be selected to be between 5 SPM and 25 SPM.

The predetermined SPM set point is entered into or received by the ABP system, as well as a drilling set point pressure ("DSP") and a connection choke back pressure set point ("CSP") (block 305) before the drilling starts. Once the pump starts pumping (block 310), the pump speed or strokes per minute ("SPM") is constantly monitored. Whenever the SPM of the pump becomes greater than the SPM set point, the BHP rises and the ABP system automatically switches to maintaining the DSP (block 320) as the desired choke pressure ("CP") needed to maintain the desired BHP while drilling.

The ABP system then modulates the choke 38 (block 330) to maintain the DSP while drilling. Whenever a connection is to be made, the pump operator turns off the pump and the mud pump slows (block 340). When the reduction in the pump speed reaches the predetermined SPM set point that is programmed into the ABP system (block 350), the controller of the ABP system automatically switches the ABP system from maintaining the DSP to maintaining a higher connection choke back pressure set point ("CSP") (block 355).

The change from DSP to CSP is made so quickly that the mud pump operator and driller can shut down the pump as quickly as they want (typically in 3-5 seconds) and can rely on the ABP system to automatically maintain the desired BHP as the ECD is lost.

In addition to changing the DSP to the CSP, the ABP system rapidly closes the choke (block 360). Because the ABP detects the slow down of the pump to the predetermined SPM set point before the flow of mud ceases, the choke is closed before the pump has completely stopped. The ABP system reacts fast enough to build up the choke pressure to the CSP before the mud flow stops and the ECD pressure has diminished to zero. Thus, the existing system pressure trapped in the wellbore (block 365) is sufficient to maintain the desired BHP. The ABP system continues to monitor the pressure gauge 36 to maintain the CSP (block 370).

If the trapped choke pressure is greater than the CSP (block 375), the ABP system will modulate or open the choke just enough to bring the trapped pressure back down to the CSP (block 380). On the other hand, if the trapped choke pressure is less than or equal to the CSP (block 385) then the choke will remain closed (block 390).

Once the controller detects the mud pump starting up, by detecting an increase in the SPM of the mud pump 12 to a speed that is greater than the predetermined SPM set point, the ABP system automatically switches the ABP system from maintaining the CSP back to maintaining the DSP (block 320). The quick change from the CSP to the DSP avoids the involvement of the mud pump operator and the driller and allows the pump to start up as quickly as desired (generally in 3-5 seconds). The choke 38 will then be modulated as before by the ABP system to maintain the DSP (block 330). On>ce the drilling restarts, the MPD/ABP systems are set to keep everything under control so that the BHP is kept between the pore pressure and the fracture pressure for the uncased formations in the well.

While the illustrative embodiment of FIG. 3 referenced SPM, DSP, and CSP set points, in some embodiments any number of set points or thresholds may be used. In some embodiments, multiple set points may be used. Such set points may relate to any number of factors or conditions, such as for example drilling speed, pressure, etc. The use of multiple set points, such as for example multiple set points in relation to a given factor or condition, may find particular utility in applications where a narrow range of pressure margins are required.

Aspects of the disclosure may be implemented using one or more chokes. In some embodiments, two or more chokes may be used as part of a manifold. The chokes may be arranged in parallel with one another.

In operation, a first choke may be active and manage pressure up to the point where this first choke is open by a threshold amount (e.g., 70% open) such that it can no longer accurately control the pressure efficiently. At this point this first choke may remain in its open position and a second choke (which may be in a fully or partially closed position) may become active and control the pressure. The second choke may control the pressure until it reaches a position where it can no longer control the pressure accurately; at this point, the first choke (which was deactivated in the open position) becomes the active choke controlling the pressure. This procedure may continue as dictated by the conditions of the well.

While some of the examples described herein relate to surface drilling applications, one of skill in the art will appreciate based on a review of this disclosure that aspects of the disclosure may be applied in other environmental contexts, such as for example subsea drilling applications.

The present disclosure permits the utilization of a quickly responding automatically controlled choke control system for the control of the annular pressure in a well during the drilling process, including during shutdowns and startups of the mud pump or while making connections in the drill string. Furthermore, the ability of the ABP system to automatically recognize and adapt to a pump shut down, Whether intended or not, to maintain a constant BHP protects the well against any unexpected pump shut down, whether due to pump failure, the loss of rig electrical power, the failure of the pump control systems, or human error. The choke control system of the present disclosure reacts so quickly to pump shut downs or start ups, that the driller and mud pump operator can rely on the MPD/ABP system to work to maintain the BHP even as the pump shuts down or starts up.

The present disclosure is particularly suited for controlling the annular pressure in a petroleum or geothermal well being drilled in a managed pressure condition. However, the system is readily adaptable to a wide variety of well control situations when drilling underbalanced, overbalanced, or neutrally balanced. This capability is of critical importance when the margin is small between the pore pressure of an exposed formation in the open hole and its fracture pressure.

Although the present disclosure and its advantages have been described in detail, it should be understood that various changes, substitutions and alterations can be made herein without departing from the spirit and scope of the disclosure as defined by the appended claims.

What is claimed is:

1. An apparatus configured to maintain a pressure within a well bore, comprising:

at least one processor; and memory having instructions stored thereon that, when executed by the at least one processor, cause the apparatus to:

determine that a pump speed is greater than a first set point;

control at least one choke to maintain a choke pressure in accordance with a second set point based on the determination that the pump speed exceeds the first set point;

determine that the pump speed is less than or equal to a third set point subsequent to determining that the pump speed is greater than the first set point; and control the at least one choke to maintain the choke pressure in accordance with a fourth set point based on the determination that the pump speed is less than or equal to the third set point;

cause the at least one choke to close subsequent to controlling the at least one choke to maintain the choke pressure in accordance with the fourth set point;

determine that the choke pressure is less than the fourth set point subsequent to causing the at least one choke to close; and cause the at least one choke to remain closed based on determining that the choke pressure is less than the fourth set point.

2. The apparatus of claim 1, wherein the fourth set point is greater than the second set point.

3. The apparatus of claim 1, wherein the first set point is equal to a value within a range of 5-25% of a drilling speed of a pump.

4. The apparatus of claim 1, wherein the at least one choke comprises a plurality of chokes.

5. The apparatus of claim 4, wherein the chokes are arranged in parallel with one another as part of a manifold, and wherein the instructions, when executed by the at least one processor, cause the apparatus to:

activate a first of the chokes and deactivate a second of the chokes in maintaining the pressure within the well bore.

6. A method for maintaining fluid pressure within a well bore, comprising:

providing a mud pump configured to pump fluid into the well bore;

providing at least one choke valve;

providing a controller having at least one processor and a memory containing stored instructions, the stored instructions including a mud pump speed set point rate, a drilling set point pressure, and a connection choke back pressure set point pressure;

wherein the controller is in signal communication with the mud pump and the at least one choke valve;

using the controller to:

determine a mud pump speed rate based on a signal input from the mud pump;

if the determined mud pump speed rate is greater than the mud pump speed set point rate, control the at least one choke valve to maintain a well fluid pressure at the drilling set point pressure; and if the determined mud pump speed rate is equal to or less than the mud pump speed set point rate, control the at least one choke valve to maintain the well fluid pressure at the connection choke back pressure set point pressure.

7. The method of claim 6, wherein the connection choke back pressure set point pressure is greater than the drilling set point pressure.

8. The method of claim 6, wherein the mud pump speed set point rate ranges from about 5% to about 25% of a drilling pump speed rate.

9. The method of claim 6, further comprising using a fluid pressure device disposed upstream of the at least one choke valve to determine the well fluid pressure, the fluid pressure device in signal communication with the controller.

10. The method of claim 6, further comprising using the controller to control the at least one choke valve to reduce the well fluid pressure, if the well fluid pressure exceeds the connection choke back pressure set point pressure.

11. An apparatus for maintaining fluid pressure within a well bore, comprising:

a mud pump in fluid communication with the well bore;

at least one choke valve in fluid communication with the well bore;

a controller in signal communication with the mud pump and the at least one choke valve, the controller having at least one processor and a memory containing stored instructions, the stored instructions including a mud pump speed set point rate, a drilling set point pressure, and a connection choke back pressure set point pressure, the stored instructions when executed cause the apparatus to:

determine a mud pump speed rate based on signal input from the mud pump;

if the determined mud pump speed rate is greater than the mud pump speed set point rate, control the at least one choke valve to maintain a well fluid pressure at the drilling set point pressure; and if the determined mud pump speed rate is equal to or less than the mud pump speed set point rate, control the at least one choke valve to maintain the well fluid pressure at the connection choke back pressure set point pressure.

12. The apparatus of claim 11, wherein the connection choke back pressure set point pressure is greater than the drilling set point pressure.

13. The apparatus of claim 11, wherein the mud pump speed set point rate ranges from about 5% to about 25% of a drilling pump speed rate.

14. The apparatus of claim 11, further comprising using a fluid pressure device disposed upstream of the at least one choke valve to determine the well fluid pressure, the fluid pressure device in signal communication with the controller.

15. The apparatus of claim 14, further comprising the stored instructions when executed cause the apparatus to use the controller to control the at least one choke valve to reduce the well fluid pressure, if the well fluid pressure exceeds the connection choke back pressure set point pressure.

* * * * *